US008205976B2

(12) United States Patent
Helterline et al.

(10) Patent No.: US 8,205,976 B2
(45) Date of Patent: Jun. 26, 2012

(54) PARTITION MAP

(75) Inventors: Brian L. Helterline, Salem, OR (US); Jefferson P. Ward, Bush Prairie, WA (US); Stephen D. Panshin, Corvallis, OR (US); Joseph H. Bauman, Brush Prairie, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/087,619

(22) Filed: Apr. 15, 2011

(65) Prior Publication Data

US 2011/0187771 A1 Aug. 4, 2011

Related U.S. Application Data

(63) Continuation of application No. PCT/US2008/080054, filed on Oct. 15, 2008.

(51) Int. Cl.
*B41J 2/175* (2006.01)

(52) U.S. Cl. ..... 347/87; 347/19; 347/86; 399/12

(58) Field of Classification Search ..... 347/19, 347/86, 87; 399/12
See application file for complete search history.

(56) References Cited

U.S. PATENT DOCUMENTS

| | | | | |
|---|---|---|---|---|
| 5,907,856 | A | 5/1999 | Estakhri | |
| 6,488,352 | B1 * | 12/2002 | Helterline et al. | 347/19 |
| 6,694,106 | B2 | 2/2004 | Yoshimura | |
| 6,738,903 | B1 | 5/2004 | Haines | |
| 7,177,552 | B2 | 2/2007 | Koike | |
| 2008/0187345 | A1 | 8/2008 | Sorihashi | |

* cited by examiner

*Primary Examiner* — Julian Huffman

(57) ABSTRACT

An imaging material supply cartridge uses a partition map to identify access modes and encryption attributes.

15 Claims, 2 Drawing Sheets

PARTITION MAP

CROSS-REFERENCE TO RELATED PATENT APPLICATIONS

The present application is a continuation of co-pending PCT/US2008/080054 filed on Oct. 15, 2008 by Brian L. Helterline, Jefferson P. Ward, Stephen D. Panshin, and Joseph H. Bauman and entitled PARTITION MAP, the full disclosure of which is hereby incorporated by reference.

BACKGROUND

Some imaging material supply cartridges include a memory for storing data. Existing schemes for identifying attributes of data stored in the memory occupy valuable memory space.

DETAILED DESCRIPTION OF THE EXAMPLE EMBODIMENTS

Figure 1:
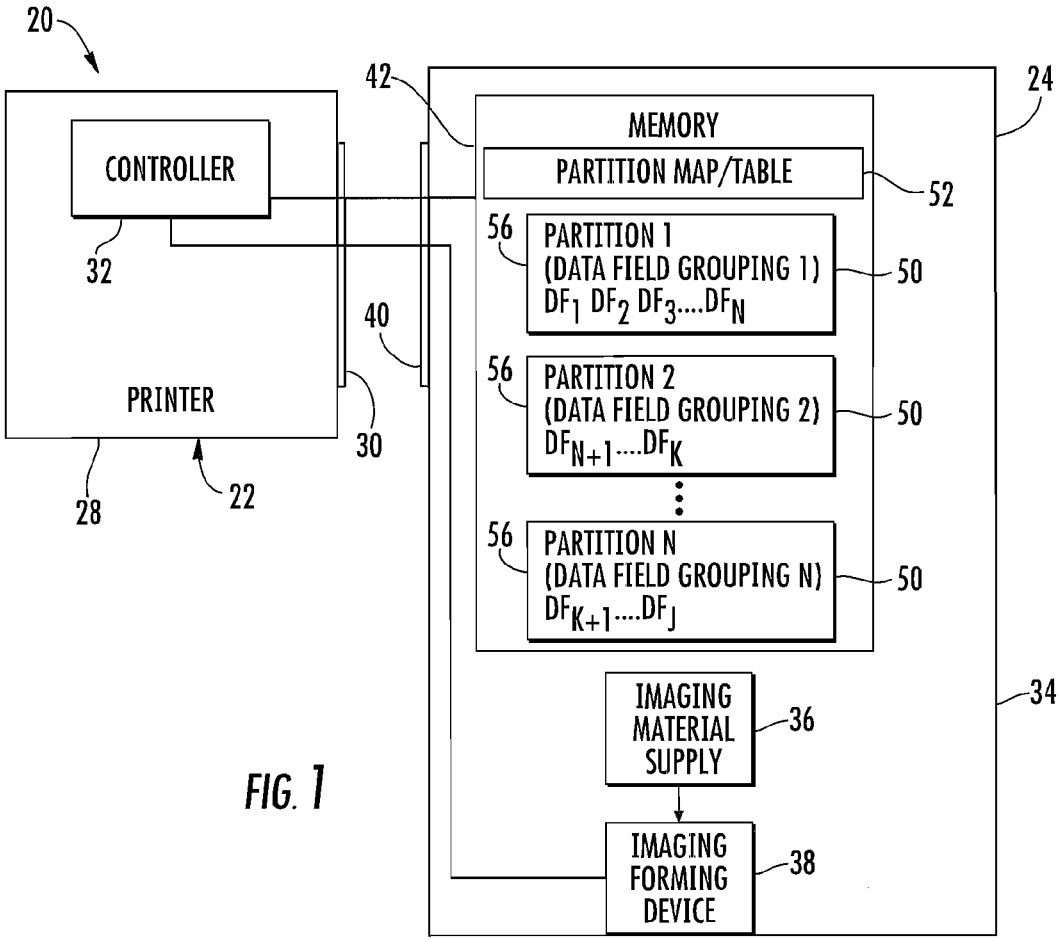
FIG. 1 is a schematic illustration of a printing system according to an example embodiment.

FIG. 1 is a schematic illustration of a printing system 20 according to an example embodiment. Printing system 20 includes printer 22 and one or more imaging material supply cartridges 24 (one of which is shown). As will be described hereafter, imaging material supply cartridge 24 identifies attributes of data stored in its memory in a more space efficient manner, providing more memory space for data storage.

Printer 22 comprises a printing, marking or imaging device configured to mark, print or otherwise deposit or form patterns or images of imaging material upon a substrate or print media. As schematically shown by FIG. 1, printer 22 includes a frame, body or housing 28, a supply interface 30 and a controller 32. Housing 28 supports the remaining elements of printer 20. Housing 28 further removably receives imaging material supply cartridge 24 or removably supports imaging material supply cartridge 24. For example, in one embodiment, housing 28 may movably support a carriage (not shown) configured to scan imaging material supply cartridge 24 across a substrate or printed medium. In another embodiment in which imaging material supply cartridge 24 extends across an entire width of a substrate or printed medium being printed upon, such as with a page wide array printing system, housing 28 removably supports the one or more substrate spanning imaging material supply cartridges 24. In one embodiment, housing 28 may additionally support a media transport (not shown) configured to transport or move a substrate or media (such as a web or sheets of media) relative to imaging material supply cartridge 24.

Interface 30 comprises a mechanism by which printer 22 communicates with imaging material supply cartridge 24. In one embodiment, interface 30 may comprise a wired connection using one or more electrical traces, electrical wires, electrical contact pads, electrical plugs and the like. While printer 22 and supply 24 are shown spaced apart, in operation, interface 30 may contact interface 40. In another embodiment, interface 30 may facilitate a wireless communication between printer 22 and cartridge 24.

Controller 32 comprises one or more processing units configured to generate control signals directing the printing or marking being performed by printing elements, such as print heads, of imaging material supply cartridge 24 or being performed using imaging material from imaging material supply cartridge 24. Controller 32 is further configured to read data stored on imaging material supply cartridge 24 and to write data to cartridge 24.

For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 32 may be embodied as part of one or more application-specific integrated circuits (ASICs). Unless otherwise specifically noted, the controller is not limited to any specific combination of hardware circuitry and software, nor to any particular source for the instructions executed by the processing unit. Although controller 32 is illustrated as part of printer 22, and other embodiments, controller 32 may be provided in a separate electronic device, such as a separate computer.

Imaging material supply cartridge 24 comprises a device configured to supply imaging material for the printing or marking upon a substrate or printed medium. In the example illustrated, imaging material supply cartridge 24 comprises body 34, imaging material supply 36, image forming device 38, interface 40 and memory 42. Body 34 comprises a framework or housing at least partially enclosing or supporting the remaining components of imaging material supply cartridge 24. Body 34 encloses or forms the imaging material supply 36. Body 34 may have a variety of different shapes and configurations.

Imaging material supply 36 comprises a volume, cavity or chamber formed within body 34 and containing imaging material. In one embodiment, imaging material supply 36 contains a liquid imaging material. Examples of liquid imaging material include, but are not limited to, chromatic inks, non-chromatic inks, chromatic toners, non-chromatic toners, fixers, embossing materials or solutions containing solutes which may be printed or marked to form mechanical, chemical or electrical structures such as transistors, chemical or electrical sensing devices, micro machines, nano-machines and the like. In one embodiment, imaging material supply 36 may contain a dry imaging material, such as a dry toner. In one embodiment, imaging material supply 36 may comprise such a chamber that is substantially enclosed or sealed, wherein upon exhaustion of the imaging material from supply 36, cartridge 24 is removed and disposed of or is refurbished with new imaging material. In another embodiment, imaging material supply 36 may alternatively be configured to be periodically or continuously replenished while connected to printer 22 from a separate imaging material supply.

Image forming device 38 comprises one or more device configured to print, mark, deposit or otherwise apply the imaging material received from supply 36 onto a substrate or printed medium. In one embodiment, image forming device 38 may comprise one or more print heads having fluid or liquid nozzles through which liquid imaging material is ejected. Examples of such liquid ejecting print heads include drop-on-demand inkjet print heads such as thermoresistive inkjet print heads and piezo resistive inkjet print heads. In another embodiment, image forming device 38 may include one or more drums or rollers configured to apply an electrostatically formed pattern or image of the imaging material onto a substrate or printed medium. In such an embodiment, the imaging material may be in a dry toner form or a liquid toner form.

In the example illustrated, image forming device 38 is embodied as part of cartridge 24 so to be carried and transported as part of cartridge 24. In other embodiments, image forming device 38 may alternatively be provided as part of printer 22 instead of cartridge 24. In such an alternative embodiment, imaging material supply cartridge 24 supplies imaging material from supply 36 to the image forming device 38 of printer 22.

Interface 40 comprises a mechanism by which printer 22 communicates with imaging material supply cartridge 24. In one embodiment, interface 40 may comprise a wired connection using one or more electrical traces, electrical wires, electrical contact pads, electrical plugs and the like. In another embodiment, interface 40 may facilitate a wireless communication between printer 22 and cartridge 24. In some embodiments, imaging material supply cartridge 24 may, itself, include a processor or controller which further communicates with the processor or controller of printer 22 or a separate processor or controller associated with or in communication with printer 22.

Memory 42 (schematically shown) comprises one or more persistent storage devices supported by body 34, physically attached to body 34, physically enclosed or contained within the body 34 or coupled to body 34 so as to be carried by body 34. In other words, memory 42 remains a part of cartridge 24 when cartridge 24 is separated from printer 22. Memory 42 comprises an electronic or computer readable memory. Examples of memory 42, include, but are not limited to, magnetic memory, optical memory, an integrated circuit or memory card and the like.

As shown by FIG. 1, memory 42 includes partitions 50 and partition map 52. Partitions 50 comprise portions, regions or blocks of memory 42. Each partition 50 includes one or more different pieces of data or data fields (DF) 56. In the example illustrated, each partition 50 includes a different grouping of different data fields 56. The data fields 56 are grouped into their various designated partitions 50 based upon attributes of the data fields 56. In the example illustrated, each data fields 56 is grouped into one of partitions 50 based upon how the particular data field 56 is to be accessed (the access mode) and whether or not or how the data field 56 is encrypted (the encryption attribute).

For example, in one embodiment, all the data fields 56 having a same access mode are grouped together in one or more partitions designated or assigned for the particular access mode. Examples of different access modes include read only, read/write, or read/write-or. The read only access mode merely allows reading of the data fields 56 in the particular partition. The read/write access mode permits both reading of data from and writing of data to the data fields 56 in the particular partition. The read/write-or mode permits data fields to be altered in one direction. For example, a read/write-or mode performs a logical OR function on input. By way of example, an input of 1 will not change an existing bit value of 1. An input of 0 will not change an existing bit value of 1. An input of 1 will change an existing bit value of 0. In one embodiment, all data fields 56 in which data is already written and which is not to be altered, but only read, maybe grouped in one partition. In such an embodiment, all data fields 56 in which data may be written or which may be read may be grouped together in another partition.

All the data fields 56 having a same encryption attribute are grouped together in one or more partitions designated for the particular encryption attribute. For example, in one embodiment, an encryption attribute may be simply (1) encrypted or (2) not encrypted (plain text). In some embodiments, the date fields 56 that are encrypted may additionally be separately grouped based upon the mode or method by which they are encrypted.

The grouping of data fields 56 based upon their access mode and based upon their encryption attribute is collectively done at a same grouping level. In other words, all data fields having both the same access mode and the same encryption attribute are grouped together in one or more designated partitions. No single partition includes data fields of more than one access mode or more than one encryption attribute.

For example, in one embodiment, partitions 50 may include six different groupings of data fields. A first partition 50 may be read-only accessible and include only encrypted data fields. A second partition 50 may be read-only accessible and include only unencrypted data fields. A third partition 50 may be read/write accessible and include encrypted data fields. A fourth partition 50 may be read/write accessible and include unencrypted data fields. A fifth partition 50 may be read/write-or accessible and include encrypted data fields. A sixth partition 50 may be read/write-or accessible and include unencrypted data fields.

In one embodiment, each byte of a particular partition 50 may have a single data field 56, wherein excess bits of the byte are merely padded. In other embodiments, data fields 56 may be stacked end-to-end within one or more data bytes, wherein only the unused data bits of the set of one or more data bytes is padded or unused. In another embodiment, the data fields 56 may be grouped in other fashions within their associated partitions 50.

Partition map/table 52 comprises a portion of memory 42 mapping, outlining, indexing or otherwise providing information or data regarding the attributes of the partitions 50 contained within memory 42 as well as the address or location of each of partitions 50 in memory 42. In one embodiment, partition map 52 is provided in a predetermined or preset unalterable portion of memory 42, whereas partitions 50 are contained in a user accessible portion of memory 42. Partition map 52 is configured to be initially read by controller 32 prior to the accessing of partitions 50.

Figure 2:
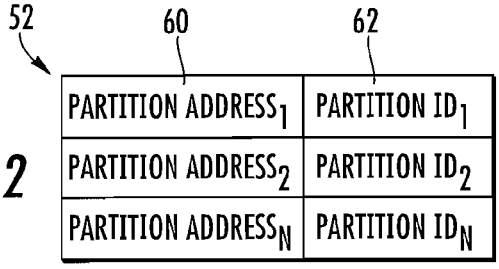
FIG. 2 is a schematic illustration of a partition map of a cartridge of the printing system of FIG. 1 according to an example embodiment.

FIG. 2 schematically illustrates partition map 52 in detail. As shown by FIG. 2, for each partition 50, partition map 52 includes a partition address portion 60 and a partitioned ID portion 62. Partition address portions 60 comprise portions of partition map 52 that identify the boundaries or addresses of partitions 50. For example, in one embodiment, each partition address 60 identifies the ending location of its associated partition 50. In other embodiments, the location or boundaries of partitions 50 may be identified in other fashions. For example, the beginning locations of each partition 50 may alternatively be identified by each partition address 60. In one embodiment, the partition address comprises a 24-bit data element that specifies the starting memory location of the data bytes in the partition. In yet other embodiments, a length of each partition may be identified by each partition address 60.

Partition ID portions 62 provide the actual attributes of the partition addressed by the partition address portion 60. Partition ID portions 62 identify both the access mode and the encryption attribute for the particular partition 50 addressed in partition address portion 60 of the partition map 52. Because each of partition ID portions 62 of partition map 52 identify both the access mode and the encryption mode, both pieces of data (the access mode and encryption mode data) can be concurrently associated with a single partition address rather than having one map that utilizes memory to associate an access mode with a certain identified range of data fields and which uses an additional map which must use additional memory space to once again identify a certain identified range of data fields for data having a selected encryption attribute. Said in another way, because each partition address corresponds to all data fields grouped according to both access mode and encryption attribute, a single partition address is associated and stored with such data rather than to storing and associating a first address for data with a same access mode and a second address for data with the same encryption attribute. As a result, valuable space within memory 42 is conserved.

Figure 3:
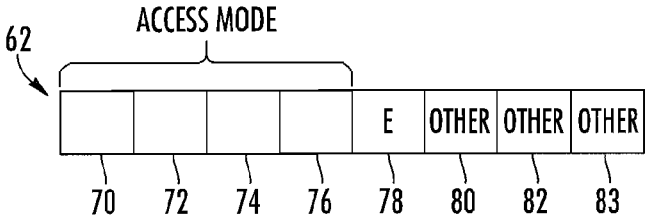
FIG. 3 is a schematic illustration of one example of a partition ID portion of the partition map of FIG. 2 according to an example embodiment.

FIG. 3 illustrates one example of a partitioned ID portion 62 for one of partitions 50 shown in FIG. 1. In the example illustrated, partition ID portion 62 includes an eight bit byte including data bits 70, 72, 74, 76, 78, 80, 82 and 83. Data bits 70-76 identify the access mode for all data fields 56 contained within the particular associated partition 50. In particular, the upper four bits, 70, 72, 74 and 76 are used as a group: 0000=read/write; and 0001=read-only; 0010=read/write-or. In other embodiments, other binary numbers may be used to indicate the different access modes.

Data bit 78 indicates or identifies with a zero or one whether all the data 56 within a particular partition 50 are encrypted. Data bits 80-83 may be used for other purposes to identify other characteristics or attributes of the data fields 56 group in the particular partition 50. For example, different data fields 56 may have different levels or degrees of encryption. In some embodiments, the data fields may also be additionally grouped based upon their different levels of encryption, wherein one or more of data bits 80-83 may indicate the particular encryption level of all of the data fields grouped into the particular partition 50 or encryption key identifier that is needed for all of the data fields grouped into the particular partition 50. In other embodiments, partition address portions 60 and partition ID portions 62 may have other bit lengths or may map a greater or fewer of such access modes with the data field groupings or partitions 50.

Figure 4:
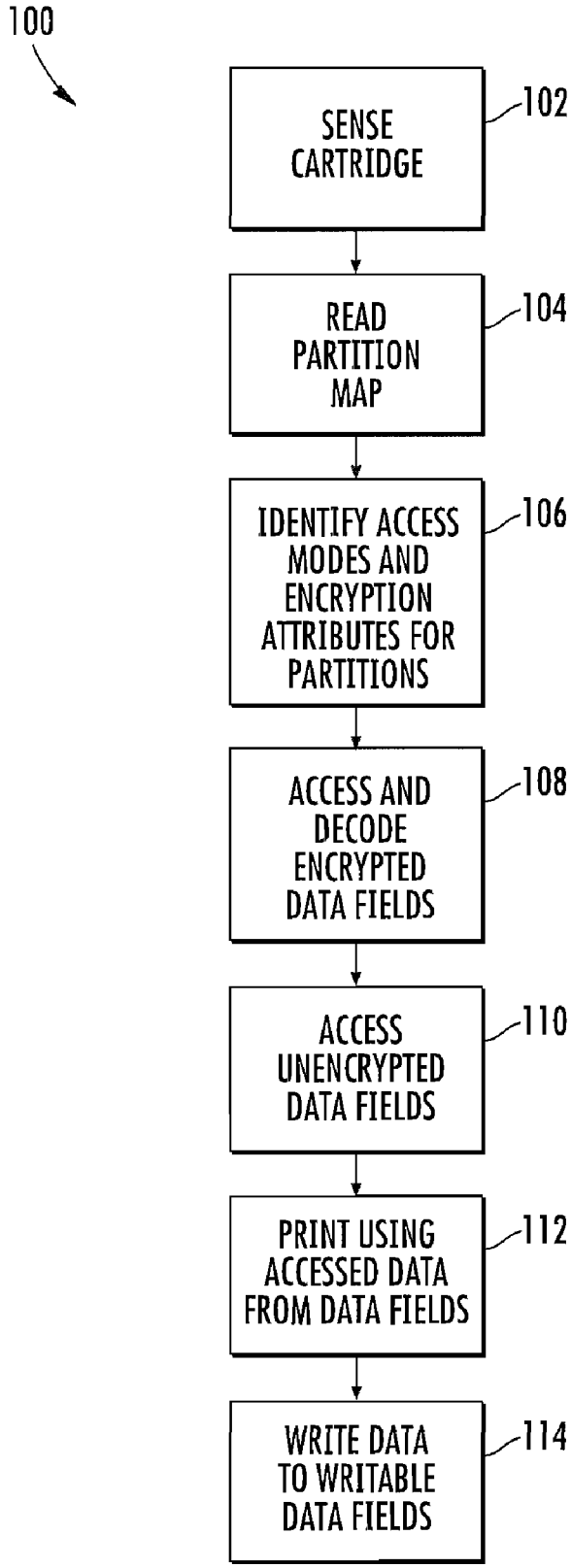
FIG. 4 is a diagram of a method of using the printing system of FIG. 1 according to an example embodiment.

FIG. 4 illustrates an example process or method 100 of using memory 42 of imaging material supply cartridge 24. As indicated by step 102, cartridge 24 is initially sensed by printer 22. This may occur upon insertion or attachment of cartridge 24 to printer 22 or may occur upon powering up of printer 22. As indicated by step 104, upon determining that cartridge 24 is connected to printer 22, controller 32 reads partition map 52. As indicated by step 106, controller 32 identifies the boundaries of each of the partitions 50 in memory 42 as well as the access modes and encryption attributes for each of the identified partitions 50. This information may be temporarily stored in the memory associated with controller 32. This information is used by controller 32 for subsequent reading and writing of data to and from memory 42. Controller 32 may additionally use the information or data read to assist in generating control signals directing image forming device 38 (shown FIG. 1).

As indicated by steps 108 and 110, controller 32 uses the access modes and encryption attribute data read from partition map 52 to assist in reading data fields in memory 42. In particular, as indicated by step 106, if controller 32 determines that particular data to be read from memory 42 is contained in a particular partition 50 identified as being encrypted, controller 32 reads such data fields and decodes or decrypts data taken from such fields before such data is used. As indicated by step 110, if controller 32 determines that the particular data to be read from memory 42 is contained in a particular partition 50 identified as not being encrypted, controller 32 may directly use such data taken from such data fields 56. Examples of data that may be stored in particular data field 56 or written to particular data fields 56 include, but is not limited to, manufacturing date, imaging material type, imaging material quantity, printing instructions, printing suggestions, print quality settings, image forming material conservation modes, authentication data, internet, web or network authorization data, authorization request information, authorization or access keys and the like.

As indicated by step 112, controller 32 uses the data accessed or read from the encrypted and unencrypted data fields to generate control signals directing image forming device 38 in the formation of images using image forming device 38. In particular embodiments, controller 32 may use the data read from data fields 56 to generate control signals communicating additional information to a person using printer 22. For example, using data from memory 42 indicating the level of imaging material left in image material supply 36, controller 32 may generate control signals causing a display or other visual or audible communication device to inform the person of the current level of imaging material within supply 36 or whether or not cartridge 24 may be running low on imaging material or need replacement in the near future.

As indicated by step 114, controller 32 may write data to writable data fields 56 within memory 42. In doing so, controller 32 uses information read from partition map 52 indicating whether particular partition 50 have access modes that permit writing of data. Although method 100 is illustrated in FIG. 4 as depicting the particular steps 102-114 in the noted order, in other embodiments, the order of such steps 106-114 may be rearranged.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An imaging material supply cartridge comprising:

a body configured to contain an imaging material; and a memory carried by the body, the memory including a partition map that identifies data field groupings, an access mode of at least one data field grouping and an encryption attribute of at least one data field grouping.

2. The imaging material supply cartridge of claim 1, wherein the access mode comprises one of a read only mode, a read/write mode, a read/write-or mode.

3. The cartridge of claim 1, wherein for each data field grouping, the partition map comprises a byte having a bit identifying the encryption attribute of the at least one data field grouping and at least two bits identifying the access mode of the at least one data field grouping.

4. The cartridge of claim 3 wherein the byte includes at least four bits identifying the access mode of the at least one of the data field grouping.

5. The cartridge of claim 1, wherein the memory does not include any data field identifiers or encryption states outside the partition map.

6. The imaging material supply cartridge of claim 1, wherein the memory is mounted to an exterior of the body.

7. The imaging material supply cartridge of claim 1, wherein the partition map is in a non-user accessible portion of the memory.

8. The imaging material supply cartridge of claim 1, wherein the partition map identifies boundaries of data field groupings with data identifying a length of each of the data field groupings.

9. The imaging material supply cartridge of claim 1, wherein each and every data field grouping has a different access mode and a different encryption attribute.

10. The imaging material supply cartridge of claim 1 further comprising one or more print heads.

11. The imaging material supply cartridge of claim 1 further comprising an imaging material in the body, wherein the imaging material comprises ink.

12. The imaging material supply cartridge of claim 1, wherein each and every data field grouping has a different access mode and a different encryption attribute.

13. An imaging material supply cartridge comprising:

a body containing imaging material;

a memory carried by the body, the memory including a partition map that identifies data field grouping locations, an access mode of each data field grouping and an encryption attribute of each data field grouping, at least one of the access modes comprising one of a read only access mode, a read/write access mode and a read/write-or access mode.

14. The imaging material supply cartridge of claim 13, wherein the imaging material comprises ink.

15. A print cartridge comprising:

a body containing imaging material;

one or more print heads that receive imaging material from the body;

a memory carried by the body, the memory including a partition map that identifies data field grouping locations, an access mode of each data field groupings and an encryption attribute of each data field groupings, at least one of the access modes comprising one of a read only access mode, a read/write access mode and a read/write-or access mode.

* * * * *